US008693938B2

(12) United States Patent
Cardoso et al.

(10) Patent No.: US 8,693,938 B2
(45) Date of Patent: Apr. 8, 2014

(54) APPARATUS AND SYSTEMS FOR HIGH PRESSURE FUSING ELECTROSTATIC OFFSET MITIGATION

(75) Inventors: George Cunha Cardoso, Webster, NY (US); Grace T. Brewington, Fairport, NY (US); Christopher Lynn, Wolcott, NY (US)

(73) Assignee: Xerox Corporation, Norwalk, CT (US)

( * ) Notice: Subject to any disclaimer, the term of this patent is extended or adjusted under 35 U.S.C. 154(b) by 63 days.

(21) Appl. No.: 13/410,908

(22) Filed: Mar. 2, 2012

(65) Prior Publication Data

US 2013/0230344 A1 Sep. 5, 2013

(51) Int. Cl.
*G03G 15/20* (2006.01)

(52) U.S. Cl.
USPC ..... 399/339; 339/330; 339/331; 118/60; 118/116

(58) Field of Classification Search
USPC ..... 399/323, 324, 331, 339; 118/60, 116
See application file for complete search history.

(56) References Cited

U.S. PATENT DOCUMENTS

| | | | | |
|---|---|---|---|---|
| 3,955,813 | A * | 5/1976 | Edwards | 271/309 |
| 4,372,247 | A | 2/1983 | Calabrese | |
| 4,525,058 | A * | 6/1985 | Hirabayashi et al. | 399/324 |
| 5,253,027 | A * | 10/1993 | Goto | 399/333 |
| 6,393,247 | B1 * | 5/2002 | Chen et al. | 399/330 |
| 6,484,099 | B1 * | 11/2002 | Holzer-Popp et al. | 702/2 |
| 6,819,904 | B2 * | 11/2004 | Terada et al. | 399/328 |
| 2009/0130462 | A1 * | 5/2009 | Kuntz et al. | 428/447 |

OTHER PUBLICATIONS

Jordan Wosnick et al.; U.S. Appl. No. 12/871,152; filed Aug. 30, 2010.

* cited by examiner

*Primary Examiner* — David Gray
*Assistant Examiner* — Francis Gray
(74) *Attorney, Agent, or Firm* — Ronald E. Prass, Jr.; Prass LLP

(57) ABSTRACT

A fusing apparatus includes a fusing roll and a backing roll that define a nip at which toner applied to marking material is fixed to paper under high pressure. A surface of the fusing roll includes a semi-conductive metal-oxide surface. Grounded conductive guides are arranged at the entrance and at the exit of the nip defined by the fusing roll and the backing roll.

15 Claims, 7 Drawing Sheets

APPARATUS AND SYSTEMS FOR HIGH PRESSURE FUSING ELECTROSTATIC OFFSET MITIGATION

FIELD OF DISCLOSURE

The disclosure relates to apparatus and systems for offset mitigation. In particular, the disclosure relates to apparatus and systems for offset mitigation for high pressure fusing such as non-thermal fusing, or cold-pressure fusing.

BACKGROUND

A typical cold-pressure fusing device feeds media substrate between two steel rolls under substantial pressure to fix marking material such as toner to the media. For example, depending on the toner design and substrate type, a pressure maybe applied at the nip defined by the two steel rolls in an amount of about 300 psi to about 10,000 psi to fuse toner to the substrate. The toner particles coalesce under pressure, and are pressed into the substrate, which may be paper, for example. Cold-pressure fusing is non-thermal fusing, and is advantageous over thermal fusing at least because cold-pressure fusing accommodates instant system turn-on, no standby power requirement, long-lasting fusing nip component life, improved reliability, reduced fusing costs, fast first-copy-out time, process speed insensitivity, reusable fuser hardware, reduced number of noise-producing system components, reduced emissions, and no fuser edge wear image quality issues.

SUMMARY

High pressure fusing and/or leveling apparatus, systems, and methods are disclosed that minimize offset of marking material due to electrostatic charge. Apparatus and systems may be implemented for non-thermal or cold pressure fusing, high pressure warm-pressure fusing and/or leveling, and appropriate printing and media processing systems.

Cold-pressure fusing is not without problems. The high pressures of, for example, several thousand psi at the fusing nip cause intimate contact between a toned image on paper and a conductive fuser roll of the nip, and consequent internal electrical charging. When the paper is stripped from the fuser roll, further charge may be generated and the toned image may tend to be attracted to the conductive fuser roll, often causing undesirable offset or transfer of marking material onto the roll. This problem may be particularly prevalent during winter months, for example, at which time low RH conditions may occur, along with use of low moisture content paper, which is prone to electrostatic phenomena. Roll material properties and roll geometry may be configured for balancing electrostatic forces at the fusing nip to mitigate marking material offset problems.

In an embodiment, apparatus may include a fusing nip defined by a fusing roll and a backing roll, the fusing roll being configured to contact a first side of a substrate processed at the fusing nip. Apparatus may include a conductive member, the conductive member being configured to directly contact a second side of the sheet.

In an embodiment, a conductive member may extend from an exit of the fusing nip, and configured for contacting the sheet as the sheet exits the fusing nip. The conductive member may comprise copper, and may be configured to guide an exiting fused sheet. In another embodiment, apparatus may include a first conductive member positioned at a fusing nip exit, and a second conductive member positioned at a fusing nip entrance.

In an embodiment, apparatus may include a fuser roll contact surface formed on the fuser roll, the contact surface being semi-conductive. Apparatus may include a backing roll surface formed on the backing roll. The backing roll surface may be conductive. The backing roll surface may comprise stainless steel. Alternatively, the backing roll surface may be semi-conductive.

In an embodiment, apparatus may include a metallic fuser roll surface. The surface may comprise metal oxide. A contact surface of a fuser roll, e.g., a surface of the fuser roll that contacts media processed at a nip defined by the roll, may comprise metal oxide selected from the group comprising titanium dioxide, chromium oxide, aluminum oxide, and silicon dioxide. Preferably, a fuser roll surface may comprise chromium oxide. Apparatus may include a fuser roll surface comprising a low dielectric constant layer having a thickness substantially equivalent to about 10 toner diameters or, about 5 um to about 500 um, and preferably a thickness lying in a range of 20 um to 50 um.

In an embodiment, fusing apparatus may include a fusing roll having a semi-conductive surface; and a backing roll, the fusing roll and the backing roll configured to define a processing nip. Apparatus may include a fuser roll having a semi-conductive surface. The fusing roll surface may be configured to minimize electrostatic charge build up resulting from pressure applied by the fusing roll during processing at the processing nip.

Apparatus may include a fusing roll surface having a low dielectric constant. The semi-conductive surface may be a metal-oxide. For example, the semi-conductive surface may comprise metal oxide such as at least one metal oxide selected from the groups comprising titanium dioxide, chromium oxide, aluminum oxide, and silicon dioxide. Preferably, a fusing roll surface may comprise chromium oxide. Apparatus may also include one or more conductive, grounded planar structures positioned at an entrance and/or exit of the fusing nip, the plane may be configured to contact media that enters/exits the processing nip. Apparatus may be configured for high pressure media processing such as cold pressure fusing, and/or warm pressure fusing or leveling and high pressure applications associated therewith.

In an embodiment, electrostatic offset mitigating fusing systems may include a high pressure nip apparatus having a pressure roll and a backing roll, the pressure roll and the backing roll configured to define a nip, the pressure roll comprising a semi-conductive surface; and at least one conductive plane, the conductive plane being arranged to contact media entering and/or exiting the nip defined by the pressure roll and the backing roll. The at least one conductive plane may be a grounded plane comprising copper. In an embodiment, the semi-conductive surface of the pressure roll may include chromium oxide.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
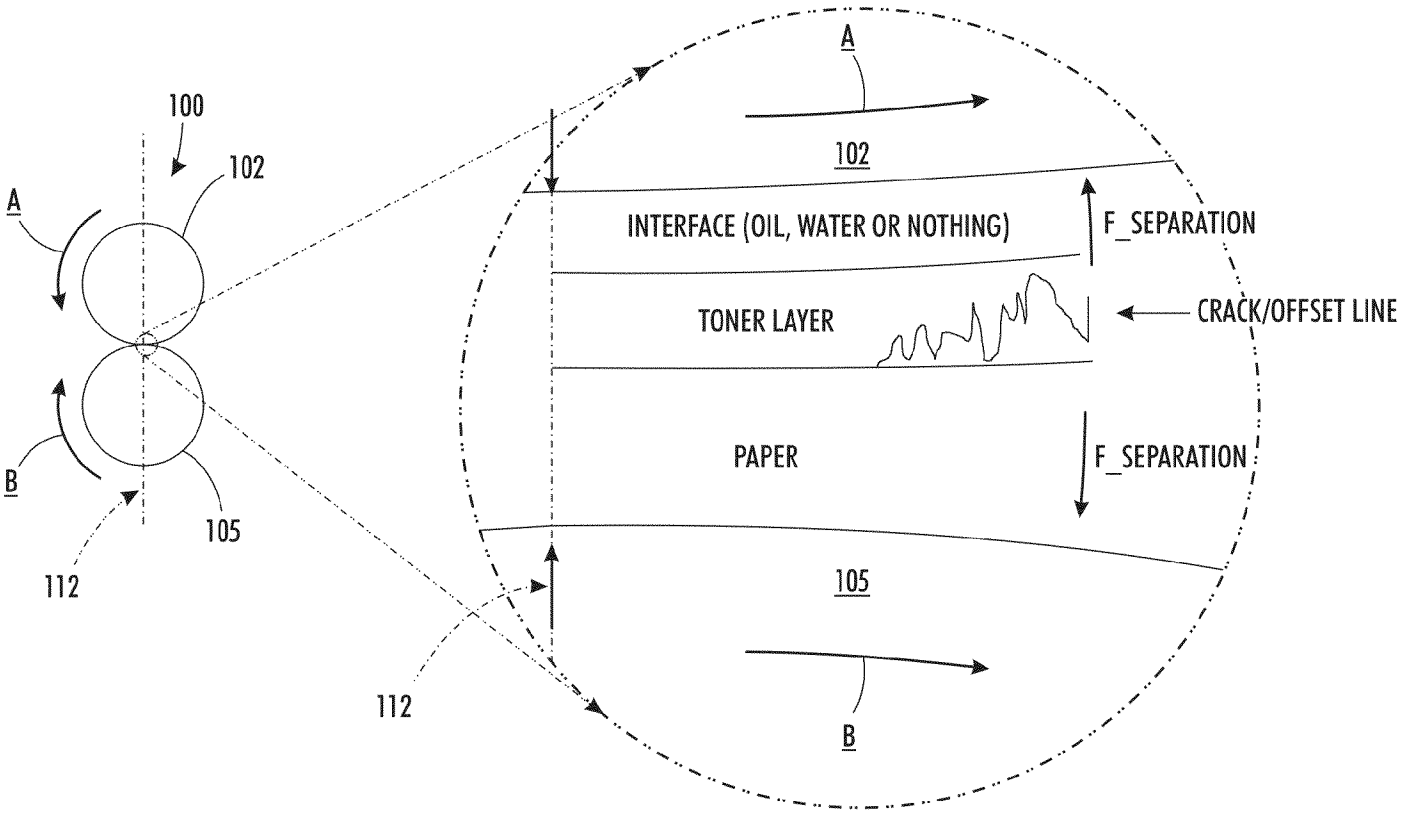
FIG. 1 shows a diagrammatical side view of related art cold-pressure fusing nip and effects of electrostatic charge on fusing toner to paper.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for mitigating marking material offset onto fusing components during cold-pressure fusing. In the drawings, like reference numerals are used throughout to designate similar or identical elements. The drawings depict various embodiments and data related to embodiments of illustrative apparatus and systems for offset mitigation.

Apparatus and systems are disclosed that mitigate offset of marking material onto fuser components during non-thermal or cold pressure fusing, and/or high pressure fusing and/or leveling. Cold-pressure fusers typically present offset problems wherein marking, e.g., toner offsets onto components of the fuser such as the fuser roll. Marking material offset has been found to be caused predominantly by, e.g., paper and/or toner tribocharging electrostatic effects. Dry and low conductivity papers or plastic substrates exacerbate offset issues. It is desirable to have a high-pressure fusing apparatus and system configured to mitigate offset while minimizing use of, for example, oils on fuser component surfaces, as accommodated by apparatus and systems of embodiments for cold pressure fusing. Other high pressure fusing systems may benefit from apparatus and systems of embodiments. For example, warm pressure fusing processes wherein marking material is fused to a substrate using low temperatures and high pressures near to those typically associated with cold pressure fusing may benefit from apparatus and systems as disclosed.

Apparatus and systems of embodiments exhibit minimal offset of marking material such as toner due to electrostatic effects. It has been found that the electrostatic effect is predominant under fusing conditions wherein pressures of several hundred pounds per square inch are applied to an unfused page at the nip. Apparatus and systems employ fuser roll geometry and/or material sets that balance electrostastic forces of, e.g., toner at a nip exit and mitigate toner offset. For example, an apparatus in accordance with an embodiment may include a semi-conductive fuser roll and a conductive pressure roll. In another embodiment, apparatus may include a conductive paper path or guide member to enhance charge-bleeding.

Non-thermal or cold-pressure fusing apparatus typically include a fusing nip defined by a fusing roll and a backing roll. A substrate such as paper onto which marking material such as toner has been deposited is passed through the nip, and the toner pressed onto the substrate at high pressure.

As shown in FIG. 1, cold-pressure fusing apparatus and systems include a fusing nip 110. The fusing nip 100 may be defined by a fusing roll 102 and a backing roll 105. The fusing apparatus may be configured so that that fusing roll rotates counterclockwise in a direction "A" while the backing roll rotates clockwise in a direction "B." Along the line 112 of the fusing nip 100, FIG. 1 shows an exploded fusing nip exit view 110 including the fusing roll 102 and the backing roll 105. It has been found that related art apparatus and systems yield fused prints that exhibit cracking and offset of marking material onto the fusing roll 102. Related art fusing roll 102 and backing roll 105 both comprise stainless steel, and in particular, have surfaces comprising stainless steel. An oil or water interface may be established between the fusing roll 102 and a substrate such as paper to be fused using an oiling system. A toner layer may interpose the oil or water layer and the substrate, and may interpose the substrate and the fusing roll 102.

During high pressure fusing in related in art apparatus and systems, intimate contact between the paper and the fusing roll 102 and backing roll 105 facilitates build-up of internal electrical charge. As paper is stripped off of the fusing roll 102 upon exiting the nip 110, further charge may accumulate, and the toner image may tend to be attracted to the related art conductive fusing roll, and may offset onto that roll. Offset may be particularly prevalent under low moisture, low RH conditions, such as during winter months in areas having appropriate climates or with low moisture content paper or other substrate types, such as thin paper or plastic or polymer, that are prone to electrostatic phenomena. FIG. 1 diagrammatically shows substantial offset of toner onto the fuser roll 102. Such offset has been found to be caused to charge buildup.

Charge buildup on paper and/or toner at a nip exit, and/or at stripper fingers associated with the fusing system may be influenced by an amount of pressure applied at the fusing nip, material involved in the process, and/or a rate of dissipation of charge. For example, charge buildup on particular substrate types such as a paper may be a function of moisture content of the paper, and an ability of the paper to dissipate charge.

Figure 2A:
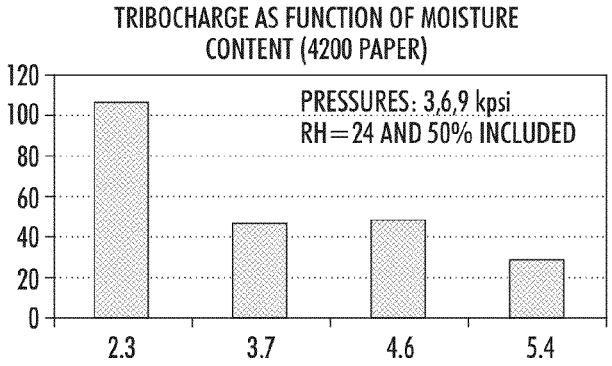
FIG. 2A is a graph showing tribocharge as a function of moisture content of 4200 paper.
Figure 2B:
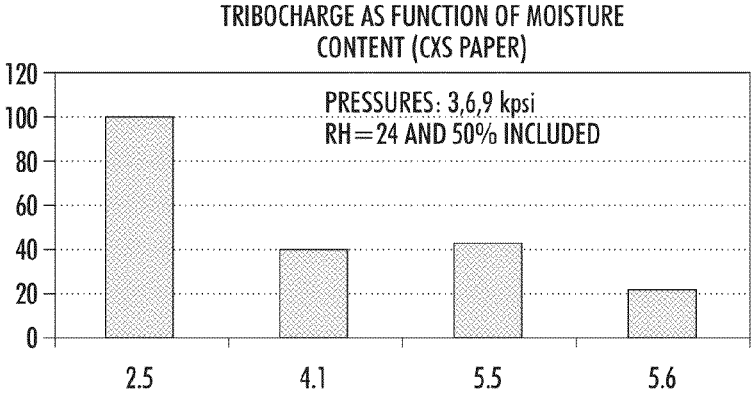
FIG. 2B is a graph showing tribocharge as a function of moisture content of CXS paper.
Figure 2C:
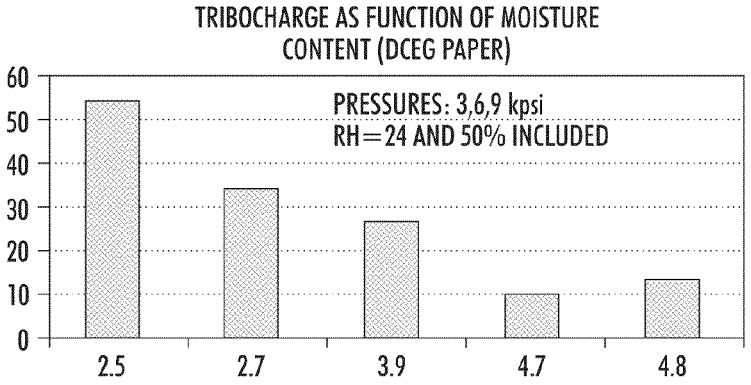
FIG. 2C is a graph showing tribocharge as a function of moisture content of DCEG paper.

FIGS. 2A-2C show that a total charge of toner and/or paper at stripper fingers of a fuser exit decreases with increasing moisture content per paper type. Among DCEG, CXS, and 4200 papers, DCEG presents the least offset of marking material onto fuser components. As shown in FIG. 2C, DCEG tribocharges the least. In particular, FIGS. 2A-2C show tribocharge levels on a ¼ of a letter-sized page of different moisture content after they pass through a nip. the several above-mentioned paper types having substantially equal moisture content. Tribocharging results shown are an average of the results obtained for 3 kpsi, 6 kpsi and 9 kpsi of nip pressure and also an average between relative room humidity (RH) of 24% and 50%. FIG. 2A shows tribocharge as a function of moisture content for 4200 paper. FIG. 2B shows tribocharge as a function of moisture content for CSX paper. FIG. 2C shows tribocharge as a function of moisture content for DCEG paper. DCEG paper accommodates the least amount of offset during a print operation, possibly due to higher substrate conductivity Introduction of oil on the fusing roll, e.g., where RH<20%, may not be sufficient for eliminating or reducing electrostatic charge buildup and resulting offset. Electrostatic offset can be problematic for high pressure fusing systems, and particularly for cold pressure fusing systems. For example, cold pressure fusing systems operate at higher pressures than thermal fusing systems, inducing a greater amount of tribocharging. Related art cold pressure fusing systems may enable an acceptable fix level, but the quality of fix does not reach the quality enabled by thermal fusing systems or warm pressure fusing systems, making the toner more vulnerable to offset.

Fusing apparatus and systems such as those in disclosed embodiments mitigate electrostatic adhesion offset of an image onto a fusing roll. Electrostatic offset of toner to a fusing roll is caused by toner electrostatic image-force attraction to the fusing roll at a moment of page strip off from the fusing roll. To mitigate the effects of electrostatic image-force attraction, a force that drives the toner toward the paper may be increased. For example, in an embodiment, a fusing nip may be configured so that a conductive member such as a metal surface is positioned on a side of the paper that is opposite from a side of the paper that faces the fusing roll. The conductive member attracts toner by way of image-force attraction, and aids in dissipating charge on the paper.

To mitigate the effects of electrostatic image-force attraction, tribocharging may be minimized by using a roll material that does not tend to promote tribocharge. For example, a roll surface may be formed of metal-oxide, semi-conductive material. Metal oxides have relatively neutral position on the triboelectric series. In an embodiment, a fusing roll and/or backing roll may be formed to include a surface having metal oxide(s).

To mitigate the effects of electrostatic image-force attraction, an image charge force may be decreased using such material sets. Metallic surfaces exhibit properties typical for surfaces having an infinite dielectric constant. Metallic surfaces attract electrically charged particle by way of image forces, even if discharged. A roll surface dielectric constant may be minimized by using a roll surface having metal oxide(s) of low dielectric constants (k). For example, a roll surface in accordance with an embodiment may include titanium dioxide (k=80). A roll surface may include chromium oxide (k=10.3); aluminum oxide (k=9); and/or silicon dioxide (k=3.9), for example. A surface may be formed to have a low dielectric constant layer having at thickness of 10 toner diameters. Preferably, a roll surface may be formed to have a low dielectric constant layer having a thickness of at least 10 toner diameters, or about 5 um to about 500 um, and preferably a thickness lying in a range of 20 um to 50 um.

Figure 3:
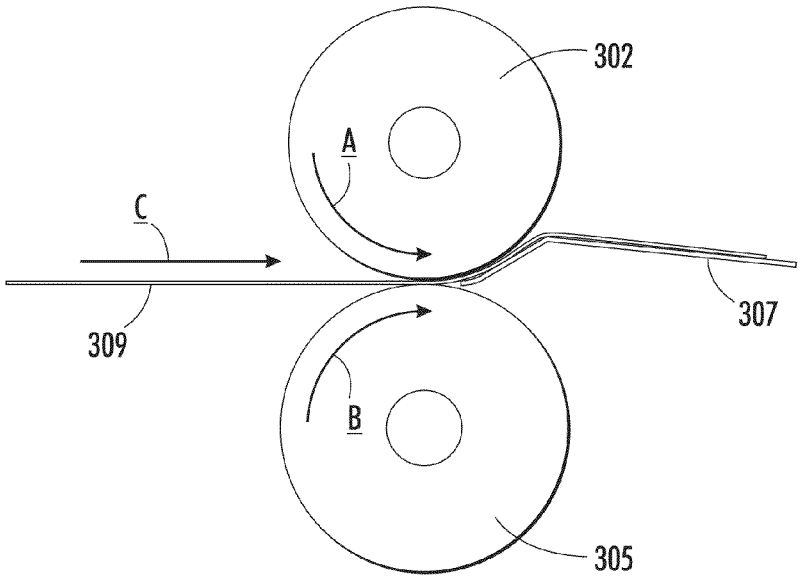
FIG. 3 a diagrammatical side view of a fusing nip in accordance with an exemplary embodiment.

FIG. 3 shows a fusing apparatus in accordance with an embodiment. In particular, FIG. 3 shows a fusing nip defined by a fusing roll 302 and a backing roll 305. The fusing roll 302 may be configured to rotate counterclockwise in process direction, as indicated by arrow "A". A backing roll maybe configured to rotate clockwise in a process direction, as indicated by the arrow "B". A grounded copper guide 307 may be arranged at a nip exit, and may be configured for bleeding charge from media, such as paper sheet 309, at the nip exit. For example, a conductive ground plane such as the grounded copper guide 307 may be configured at an exit of the nip, and may extend therefrom for guiding media from the nip exit. The conductive plane or guide member may be configured to contact media that exits the nip for bleeding charge from the media.

A substrate such as paper 309 may be fed through the nip for fusing wherein high pressures are applied to fix marking material to the paper. A substrate such as a paper web or cut sheet, or plastic or polymer such as packaging may be fed to a fusing nip of apparatus and systems after marking material such as toner is deposited onto the substrate. Apparatus and systems may accommodate fusing with mitigated toner offset even when fusing very thin paper or plastics, which tends to be difficult with related art fusing apparatus and systems, and paper that is dry or has low conductivity. An exemplary applicable marking material may be aggregate emulsion toner, or phase change inks. For example, exemplary marking material for use with high pressure fusing may include toner as described by Wosnick et al. in "Toner Processes," U.S. patent application Ser. No. 12/871,152, filed Aug. 30,2010.

As the substrate is passed through the fusing nip, the toner is squeezed thereon at high pressure. For example, in cold pressure fusing, a pressure of about 300 psi to about 10,000 psi may be used. Apparatus and systems may be useful for warm pressure fusing pressures in a range of about 100 psi to 2000 psi, for example.

As the paper 309 is squeezed between the two rolls, fusing roll 302 and backing roll 305 at the nip, charge buildup occurs. To mitigate resulting image force attraction, a conduction ground plane such as grounded copper guide 307 may be used to bleed the charge by attracting charged toner to the ground plane. In an embodiment, the fusing roll 302 and/or the backing roll 305 may be formed of stainless steel, the ground plane 307 being configured at a nip exit.

In an embodiment, the fusing roll 302 and/or the backing roll 305 may include a surface having a low dielectric constant. For example, a surface of the fusing roll 302 and/or the backing roll 305 may include metal oxide(s). A roll surface in accordance with an embodiment may include titanium dioxide (k=80). A roll surface may include chromium oxide (k=10.3); aluminum oxide (k=9); and/or silicon dioxide (k=3.9), or other suitable metal oxide. Preferably, a roll surface may comprise chromium oxide, which has been found to be suitable for printing at high pressures typically associated with non-thermal cold pressure fusing, while other materials may be more suitable for high pressure thermal fusing such as warm pressure fusing, which entails fusing at high pressures, although slightly lower than those associated with cold pressure fusing.

Figure 4A:
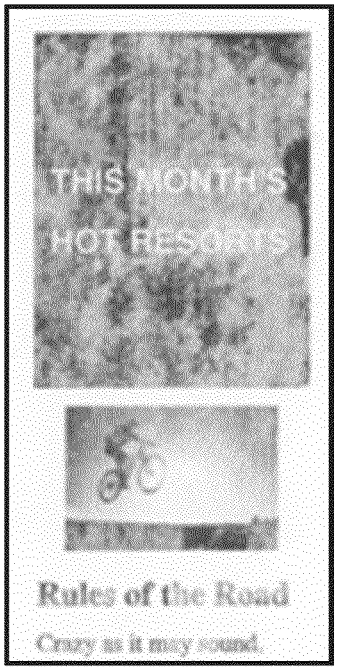
FIG. 4A shows a printed image comprising toner cold-pressure fused to paper using a bare steel roll of a related art fusing nip.
Figure 4B:
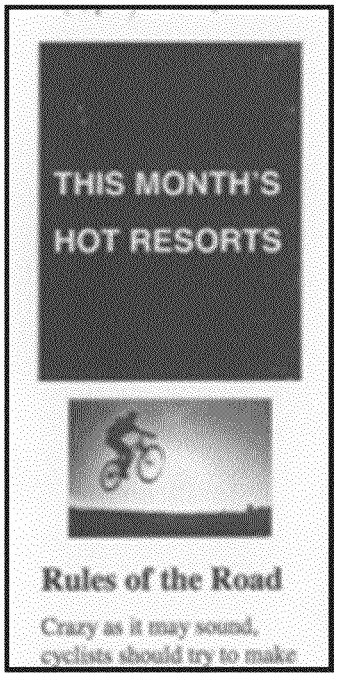
FIG. 4B shows a printed image comprising toner cold-pressure fused to paper using a fusing nip in accordance with an embodiment.
Figure 5A:
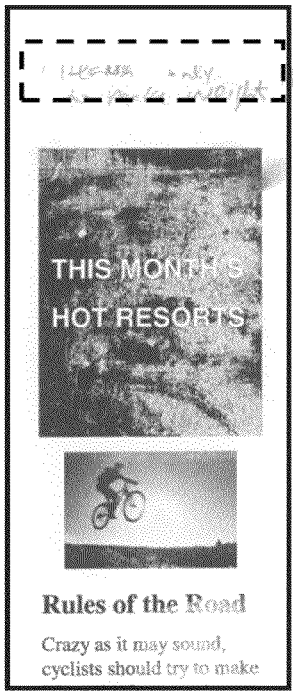
FIG. 5A-5B show cold-pressure fused images.
Figure 5B:
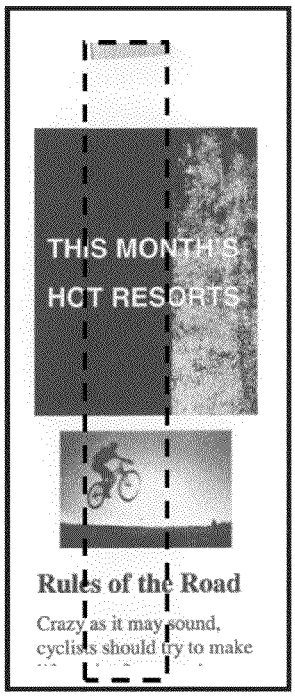
Figure 5C:
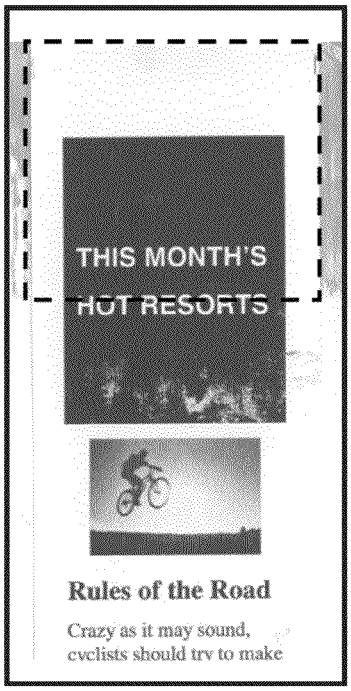
Figure 5D:
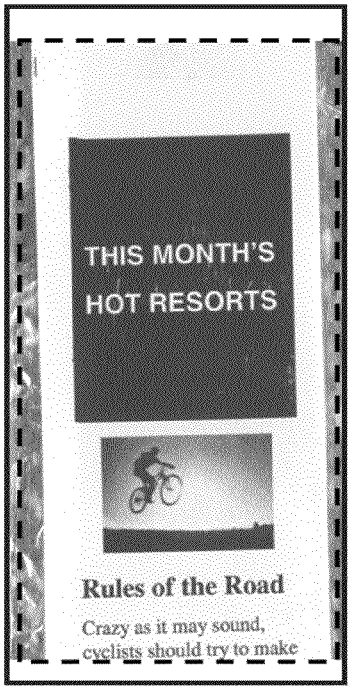

FIG. 4A shows an image print indicative of undesirable offset. The image was printed using a related art cold pressure fusing apparatus and system having steel rolls. FIG. 4B shows an image print having quality that is improved over that shown in FIG. 4B, indicative of minimal or no offset. The images were printed using a cold pressure fusing system configured as follows: toner pinot variant JW 607-58, 5 kpsi, 73F, RH 63%, CX+, paper moisture content 6%, 1 ips, no oil. FIG. 4B shows an image printed using a cold pressure fusing apparatus and system configured with a conduction ground plane in accordance with an embodiment.

FIGS. 5A-5D show images printed on paper and fused using aluminum foil for electrostatic holding. The images were printing using a cold pressure fusing apparatus and system under processes having the following parameters: toner pinot variant JW 607-58, 5 kpsi, 73F, RH 63%, CX+, paper moisture content 6%, speed: 1 ips, no oil. The images were cold pressure fused directly under a bare steel roll. The dashed lines in FIGS. 5A-5D represent a contour of the region under which the aluminum foil was located under the page during fusing. FIGS. 5A-5D show that offset was reduced for printed regions under which aluminum foil was placed during fusing.

Figure 6:
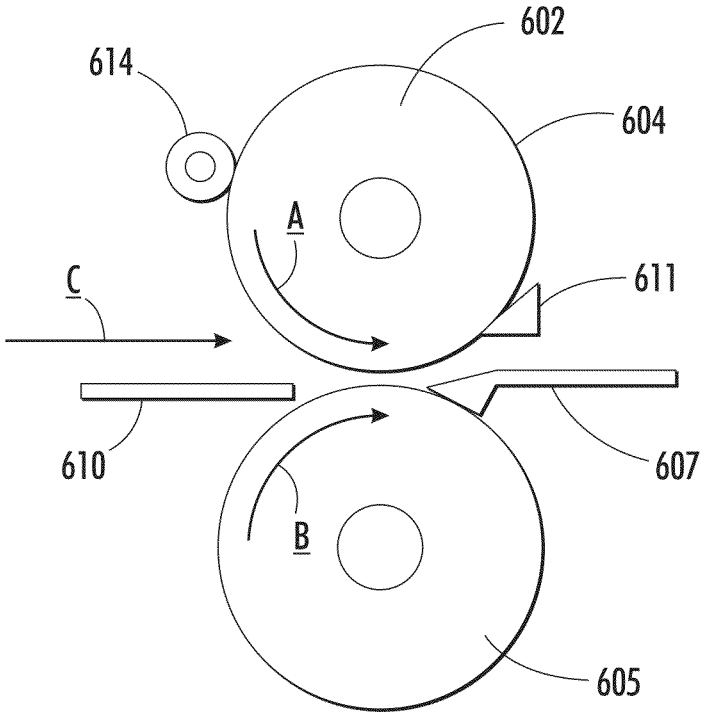
FIG. 6 shows a cold pressure fusing apparatus in accordance with an embodiment.

FIG. 6 shows an embodiment of offset mitigating cold pressure fusing apparatus and systems. FIG. 6 shows a fusing nip defined by a fusing roll 602 having a fusing roll surface 604. The fusing nip may be defined by a backing roll 605 that opposes the fusing roll. A grounded conduction plane 607 may be arranged at an exit of the nip. The conduction plane 607 may be a grounded copper guide that extend from the nip exit and is configured to contact a substrate such as a paper sheet as the paper sheet exits the nip formed by the fusing roll 602 and the backing roll 605. In particular, the grounded conduction plane 607 may be conductive, preferably highly conductive, and configured for attracting electrostatic charged particles, increasing a driving force of toner to paper and aids in dissipating charge from the paper. Accordingly, offset of marking material to the fusing roll 602, e.g., a time when a fused paper sheet exits the fusing nip and is stripped from the fusing roll 602 by a stripping finger 611 may be prevented or minimized. An oiling mechanism 614 may be positioned and configured for delivering oil to a surface of the fusing roll 602.

In an embodiment, apparatus may include a first grounded conduction plane 607 and a second grounded conduction plane 610. The first conduction plane 607 may be located at a nip exit. The second conduction plane 610 may be located at a nip entrance. One or both of the first and second grounded conduction planes 607 and 610 may be implemented in apparatus for, e.g., increasing a driving force of toner to paper and aiding in dissipating charge from the paper.

In an embodiment, fusing roll 602 may be configured to rotate counterclockwise in a process direction as shown by arrow "A." Backing roll 605 may be configured to rotate clockwise in a process direction as shown by arrow "B." As roll 602 and roll 605 rotate in a process direction, a paper sheet may pass through the fusing nip in a direction "C" whereby high pressure is used to fuse marking material to the paper. Other suitable substrates such as thin plastics may be used. The fusing nip may be configured to apply pressures in a range of about 300 psi to about 10,000 psi, which are high pressures typical for cold pressure fusing processes. Apparatus and systems in accordance with embodiments may be suitable and advantageous for warm pressure fusing processes, in which fusing pressures of about 1000 psi or above are used, or pressures high enough to trigger electrostatic offset. While cold pressure fusing is a non-thermal process, warm pressure fusing includes a step of applying heat to a substrate at a fusing nip. Electrostatic offset has been found to be less problematic for warm pressure fusing processes wherein heat is applied at temperatures of about 85° and above.

In an embodiment, a fusing roll 602 may be formed of stainless steel. In another embodiment, fusing roll 602 may have a surface that is semi-conductive. For example, a surface of the fusing roll 602 and/or the backing roll 605 may comprise metal oxide(s). A roll surface in accordance with an embodiment may include titanium dioxide (k=80). A roll surface may include chromium oxide (k=10.3); aluminum oxide (k=9); and/or silicon dioxide (k=3.9), or other suitable metal oxide. Preferably, a roll surface may comprise chromium oxide, which has been found to be suitable for printing at high pressures typically associated with non-thermal cold pressure fusing, while other materials may be more suitable for high pressure thermal fusing such as warm pressure fusing, which entails fusing at high pressures. In an embodiment, a surface of a fusing roll 602 may comprise chromium oxide, and may have a sheet resistance of 10^8 to 10^9 ohm/square at 1 kV, for example.

A backing roll 605 may be formed of stainless steel. A backing roll 605 may be conductive and grounded. In another embodiment, a backing roll 605 may be semiconductive. For example, a backing roll 605 may have a surface comprising chromium oxide, and a sheet resistance of 10^8 to 10^9 ohm/square at 1 kV, for example.

In an embodiment, both a grounded plane 607 and a semi-conductive fusing roll 602 may advantageously combined. For example a grounded plane 607 may be configured for enhancing charge dissipation on a sheet at a fusing nip formed by the fusing roll 602 and the backing roll 605, and mitigating image forces attracting charged toner to the fusing roll 602. A fusing roll having a semi-conductive surface such as a metallic surface comprising metal oxide(s) may be implemented for minimizing image charge force, and tribocharge.

Printing systems may include fusing apparatus and systems in accordance with embodiments. For example, printing systems may implement high pressure fusing systems having a conductive grounded backing plane such as grounded plane 607 located at a nip exit and/or a grounded backing plane 610 located at a nip entrance. Printing systems may implement a fusing roll or both a fusing roll and a backing roll comprising semi-conductive surface(s). Apparatus and systems for high pressure fusing configured for electrostatic offset mitigation may be implemented in systems configured for use with suitable toners, including emulsion-aggregation toner. Further, apparatus and systems may be configured for implementation as an effective spreader for phase-change ink printing applications. Offset mitigating apparatus and systems accommodated a broad usable printing substrate range, including thin paper, and thin plastics or polymers, for a broad range of printing applications, including packaging.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A fusing apparatus, the apparatus having a fusing nip defined by a fusing roll and a backing roll, the fusing roll being configured to contact a first side of a substrate processed the fusing nip, comprising:

a conductive member, the conductive member being configured to directly contact a second side of the substrate; and a fuser roll contact surface formed on the fuser roll, the contact surface being semi-conductive;

wherein the fuser roll contact surface further comprising chromium oxide.

2. The apparatus of claim 1, the conductive member extending from an exit of the fusing nip, and configured for contacting the substrate as the sheet exits the fusing nip.

3. The apparatus of claim 1, the conductive member comprising copper.

4. The apparatus of claim 1, comprising:

a backing roll surface formed on the backing roll, the backing roll surface being conductive.

5. The apparatus of claim 1, fuser roll contact surface further comprising:

metal oxide.

6. The apparatus of claim 1, the fuser roll contact surface further comprising a metal oxide selected from the group comprising titanium dioxide, chromium oxide, aluminum oxide, and silicon dioxide.

7. The apparatus of claim 1, the fuser roll contact surface comprising a low dielectric constant layer having a thickness substantially equivalent to about 10 toner diameters or about 5 um to 500 um.

8. The apparatus of claim 1, the conductive member extending from an entrance of the fusing nip, and configured for contacting the sheet as the sheet enters the fusing nip.

9. A fusing apparatus, comprising:

a fusing roll having a semi-conductive surface; and a backing roll, the fusing roll and the backing roll configured to define a processing nip;

wherein the semi-conductive surface of the fusing roll further comprising chromium oxide.

10. The apparatus of claim 9, comprising the semi-conductive surface being configured to minimize electrostatic charge build up resulting from pressure applied by the fusing roll during processing at the processing nip.

11. The apparatus of claim 9, the semi-conductive surface of the fusing roll further comprising:

metal oxide.

12. The apparatus of claim 9, the semi-conductive surface of the fusing roll further comprising:

at least one metal oxide selected from the group comprising titanium dioxide, chromium oxide, aluminum oxide, and silicon dioxide.

13. The apparatus of claim 9, comprising:

at least one of a first conductive, grounded plane positioned at an exit of the fusing nip, the plane being configured to contact media that exits the processing nip, and a second conductive, grounded plane positioned at an entrance of the fusing nip, the plane being configured to contact media entering the processing nip.

14. The apparatus of claim 13, the semi-conductive surface of the fusing roll further comprising chromium oxide.

15. The apparatus of claim 14, the backing roll comprising a conductive surface.

* * * * *